US007980177B2

(12) United States Patent
Styles et al.

(10) Patent No.: US 7,980,177 B2
(45) Date of Patent: Jul. 19, 2011

(54) HAT PALLET FOR DIGITAL IMAGE PRINTING AND METHOD FOR PRODUCING A PRINTED HAT

(75) Inventors: Jonathan D. Styles, Needham, MA (US); Barry M. Parent, Windsor (CA)

(73) Assignee: Vistaprint Technologies Limited, Hamilton (BM)

( * ) Notice: Subject to any disclaimer, the term of this patent is extended or adjusted under 35 U.S.C. 154(b) by 665 days.

(21) Appl. No.: 12/020,933

(22) Filed: Jan. 28, 2008

(65) Prior Publication Data

US 2009/0188404 A1 Jul. 30, 2009

(51) Int. Cl.
*B41F 17/38* (2006.01)

(52) U.S. Cl. ..... 101/483; 101/41; 101/474; 101/126

(58) Field of Classification Search ..... 101/41, 101/126, 474, 483; 112/103; *B41F 17/38*
See application file for complete search history.

(56) References Cited

U.S. PATENT DOCUMENTS

| | | | | |
|---|---|---|---|---|
| 3,244,093 | A | 4/1966 | Vasllantone | |
| 4,612,856 | A | 9/1986 | Jennings | |
| 4,708,057 | A * | 11/1987 | Hogenson | 101/129 |
| RE32,731 | E * | 8/1988 | Jennings et al. | 101/35 |
| 5,014,614 | A | 5/1991 | Thieme | |
| 6,775,934 | B1 | 8/2004 | Gallik et al. | |

FOREIGN PATENT DOCUMENTS

GB 1429563 A 3/1976

* cited by examiner

*Primary Examiner* — Leslie J Evanisko
(74) *Attorney, Agent, or Firm* — Jessica J. Costa

(57) ABSTRACT

A hat pallet for use in a printer which prints an image onto a hat of the type having a cap and a bill attached thereto includes a bottom plate and a top plate mountable in a closed position over the bottom plate. The bottom plate includes a printing plate and a bill support fixedly mounted thereon. The top plate has an opening exposing at least a portion of the printing plate when the top plate is in the closed position. The bill support is positioned relative to the printing plate such that when the hat is mounted in the pallet with the top plate in the closed position, a portion of the cap on which the image is to be printed is supported on the printing plate and exposed through the opening of the top plate and the underside of the bill of the hat is supported by the bill support.

20 Claims, 7 Drawing Sheets

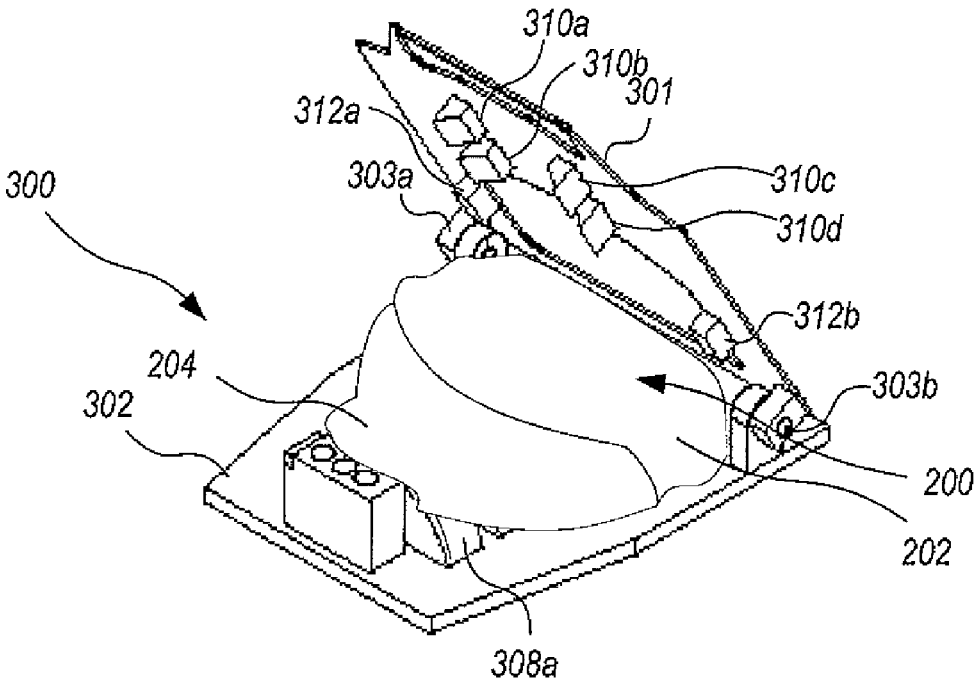
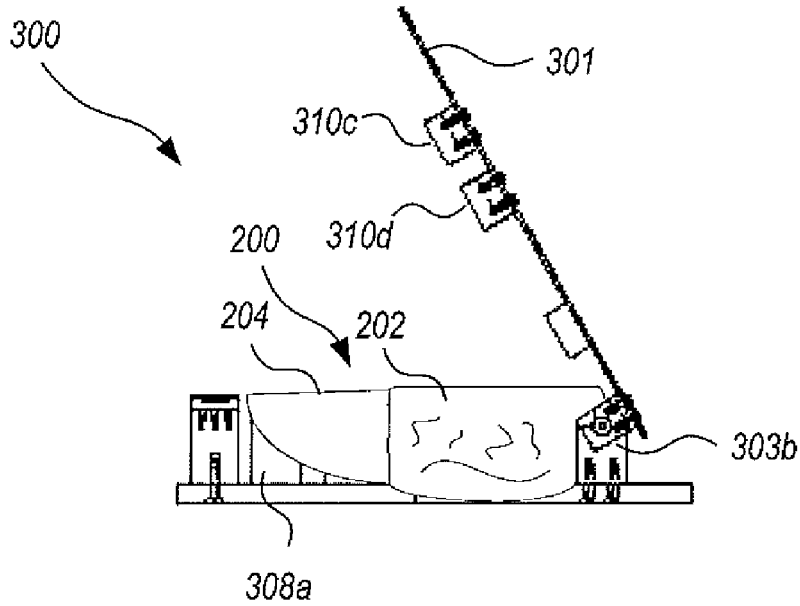
FIG. 4A
FIG. 4B

HAT PALLET FOR DIGITAL IMAGE PRINTING AND METHOD FOR PRODUCING A PRINTED HAT

FIELD OF THE INVENTION

This invention relates to printing digital images on apparel, and more particularly to a novel pallet for printing images on hats.

BACKGROUND OF THE INVENTION

Direct printing of images or graphic designs onto apparel such as t-shirts has been done for years. Typically, an item of apparel is loaded onto a pallet which secures the apparel fabric in place and stretches it flat. Prior art pallets are designed for printing on flat surfaces. Apparel such as t-shirts, which can be easily positioned to lie flat, conform naturally to these types of pallets. However, for items of apparel that are inherently 3-dimensional even when laying on a flat surface, such as baseball caps, these types of pallets can be problematic. Accordingly, a need exists for a pallet which allows flat printing onto a 3-dimensional hat.

SUMMARY

Embodiments of the invention are directed at supporting a hat in its natural position for direct digital image printing.

In accordance with one embodiment of the invention, a pallet for a printer which prints an image onto a hat having a cap with a bill attached thereto, includes a bottom plate, a printing plate mounted on the bottom plate, a top plate movable between an open position and a closed position, the top plate comprising an opening, and a bill support mounted on the bottom plate, wherein the bill support is positioned such that when the hat is mounted in the pallet with the top plate in the closed position, a portion of the cap on which the image is to be printed is supported on the printing plate and exposed through the opening of the top plate and the underside of the bill of the hat is supported by the bill support.

In accordance with another embodiment of the invention, a method for producing a hat having an image printed thereon, the hat comprising a cap with a bill attached thereto, includes mounting a hat on a pallet, the pallet comprising a bottom plate, a printing plate and a bill support each mounted on the bottom plate, and a top plate movable between an open position and a closed position and having an opening, wherein the bill support is positioned such that when the hat is mounted on the pallet and the top plate is in the closed position, a portion of the cap is positioned on the printing plate and exposed through the opening of the top plate and the underside of the bill of the hat is supported by the bill support, printing an image on the portion of the cap exposed through the opening of the top plate, and removing the hat from the pallet.

It is an advantage of the invention that the bill of the hat is fully supported and the fabric of the cap is held flat and taut for printing. The pallet may be further designed to shape the bill into a desired peak during the printing process.

These and other objects, features and advantages of the invention will be better understood with reference to the accompanying drawings, description and claims.

BRIEF DESCRIPTION OF THE DRAWINGS

FIG. 4A is a perspective view of the hat pallet of FIGS. 3A-3D with the top plate open and the cap of a hat mounted over the printing plate and the bill of the hat mounted over the bill support;

FIG. 4B is a side view of the hat pallet of FIGS. 3A-3D with the top plate open and the cap of a hat mounted over the printing plate and the bill of the hat mounted over the bill support;

DETAILED DESCRIPTION

It will be understood that, while the discussion herein describes an embodiment of the invention in the field of preparation of customized printed hat, it will be understood that the invention is not so limited and is relevant to any application for displaying an image intended to depict the actual appearance of a 3-D curved object after a flat design is printed or projected onto the physical object.

Figure 1A:
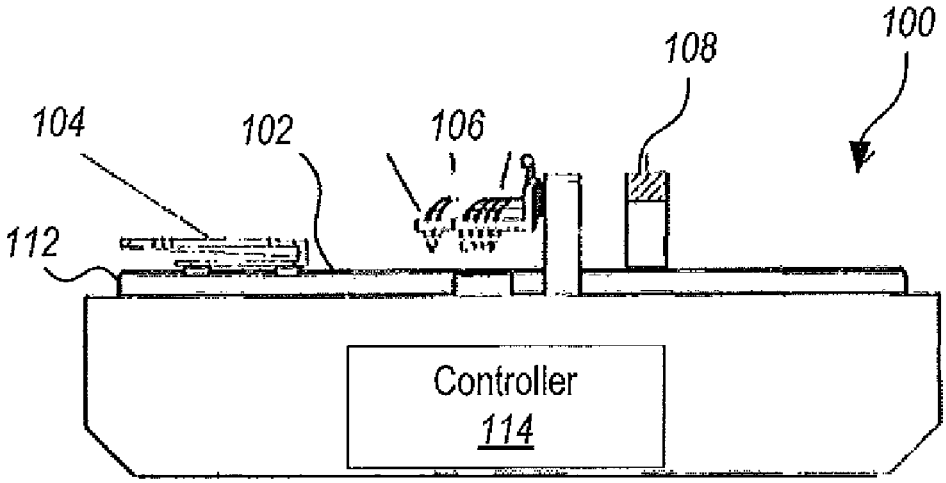
FIG. 1A is a side view of a digital image printer for printing digital images directly onto apparel.

FIGS. 1A and IB illustrate a digital image printer 100 for printing digital images directly onto apparel such as t-shirts and hats. The printer 100 includes a printing table 102 having a pallet 104 mounted thereon for holding an apparel piece 110. The printer 100 also includes an array of inkjet print heads 106 and a curing unit 40. The printing table 102 is mounted on a conveyance system 112 which conveys the printing table 102 along a pre-determined path past the operative ends of the print heads 106 and the curing unit 108. The conveyance system 112 may be any automated or manual means for conveying the printing table 102 along the predetermined path. For example, in one embodiment, the conveyance system 112 is an automated conveyor belt system under the control of a computer program. In another embodiment, the conveyance system 112 is a set of rollers over which the printing table slides when manually guided by a human operator.

A controller 114 is coupled to the printer 100 for causing printing of a digital image on the apparel piece 110 on the pallet 104 as the printing table 102 passes the print heads 106. For a color image, the printing of the image is achieved by placing ink drops at different adjacent sites as discreet, physically non-mixed drops. The ink composition used must prevent the drops from "bleeding" on the applied media. In the illustrated embodiment, the image is printed by an array of color printing heads 106. The image is printed using subtractive primary colors: Cyan, Yellow, Magenta, and Black (CYMK), for example, using transparent ink. When printing on dark colored apparel, a layer of white ink may first be printed prior to printing the CYMK process. The printing may require a single pass, or series of passes, to complete the printing of the image on the apparel piece 110. After the printing process is complete, the controller 114 causes the printing table 102 to convey the apparel piece 110 on the pallet 104 past the curing unit 108 to cure the ink on the apparel piece 110. The curing may require a single pass, or series of passes, to complete the curing of the ink.

The curing unit 108cures ink deposited by the inkjet printing heads 106 on the apparel piece 110 on the table, although, alternatively, the ink could be allowed to dry and cure by itself with time. During the printing process, the each layer of the image is cured and fixed by a curing unit 108 to prevent its dissolution with the next masking layer. This can be accomplished in any conventional manner, such as UV curing lamp, IR, hot air, etc., depending on the specific ink type and application.

Figure 2:
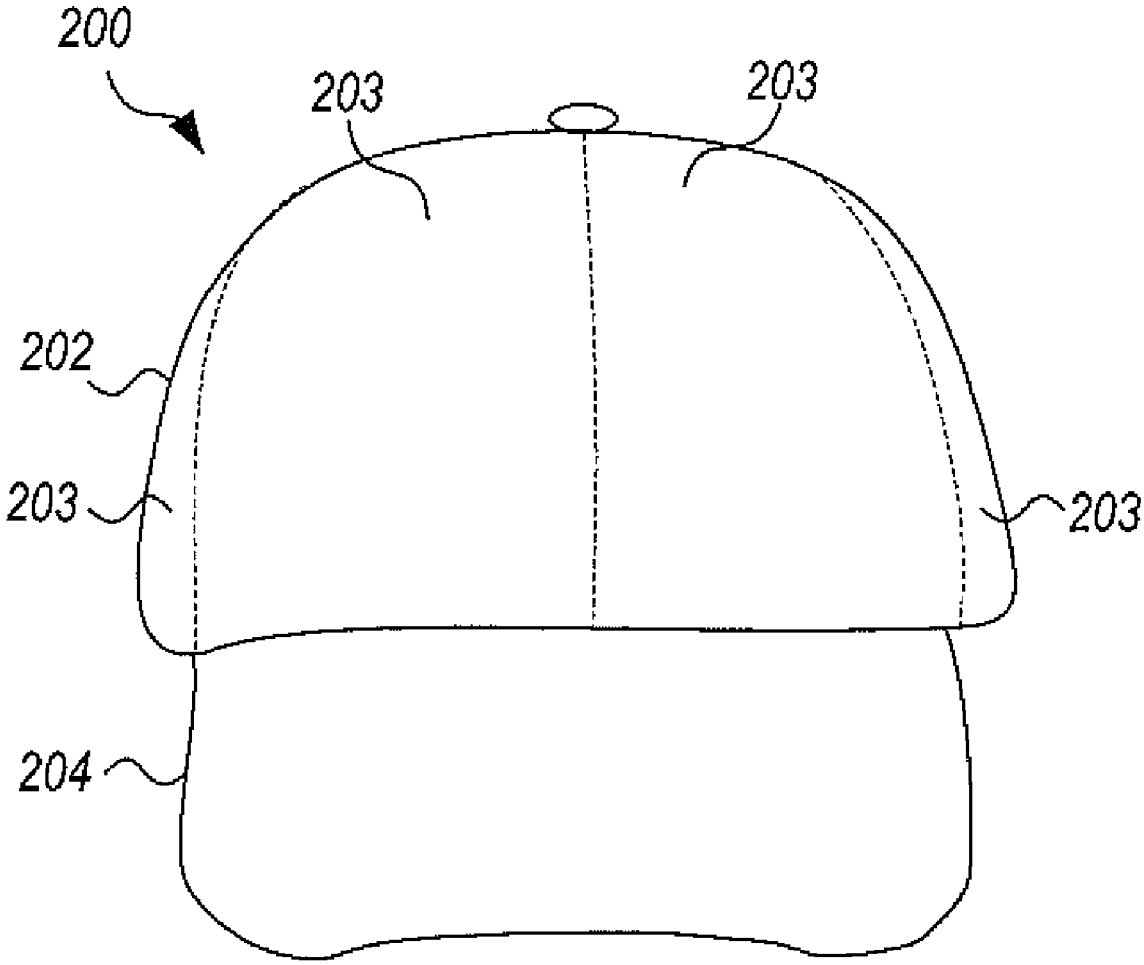
FIG. 2 is a front view of a traditional baseball cap.
Figure 3A:
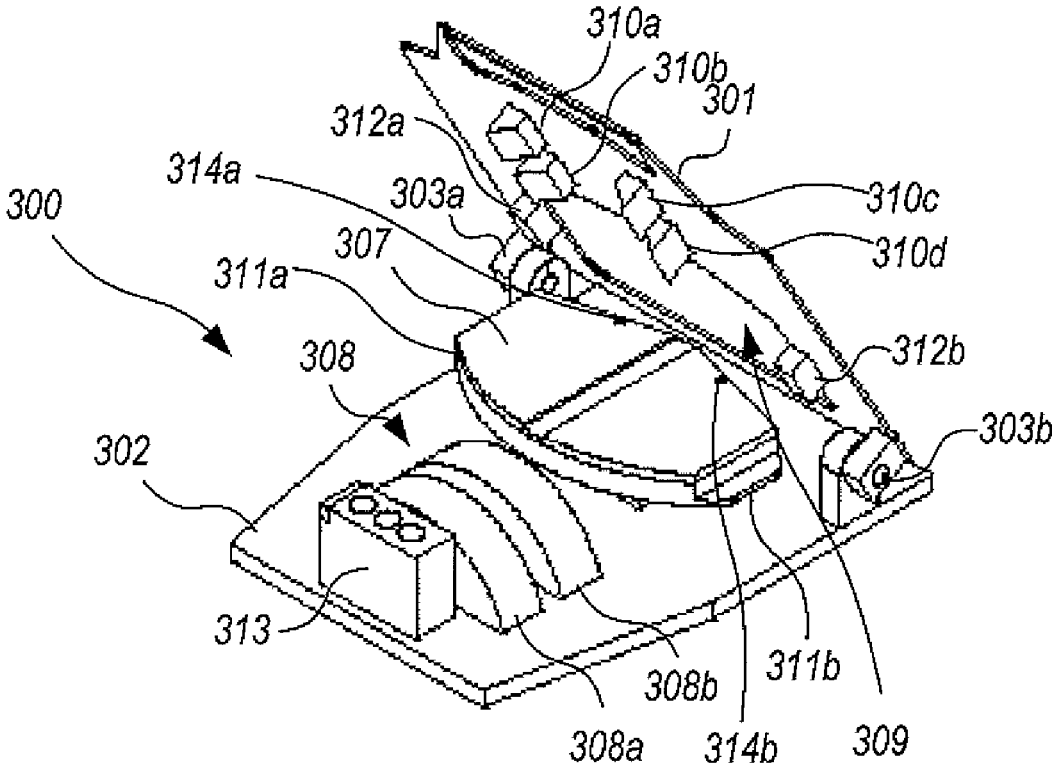
FIG. 3A is a perspective view of an exemplary embodiment of a hat pallet with the top plate open.
Figure 3B:
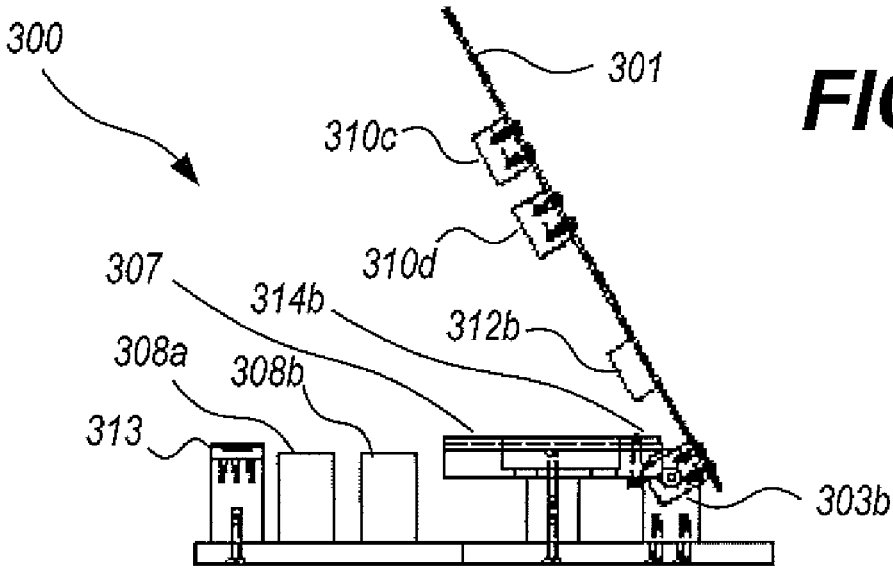
FIG. 3B is a side view of the hat pallet of FIG. 3A.
Figure 3C:
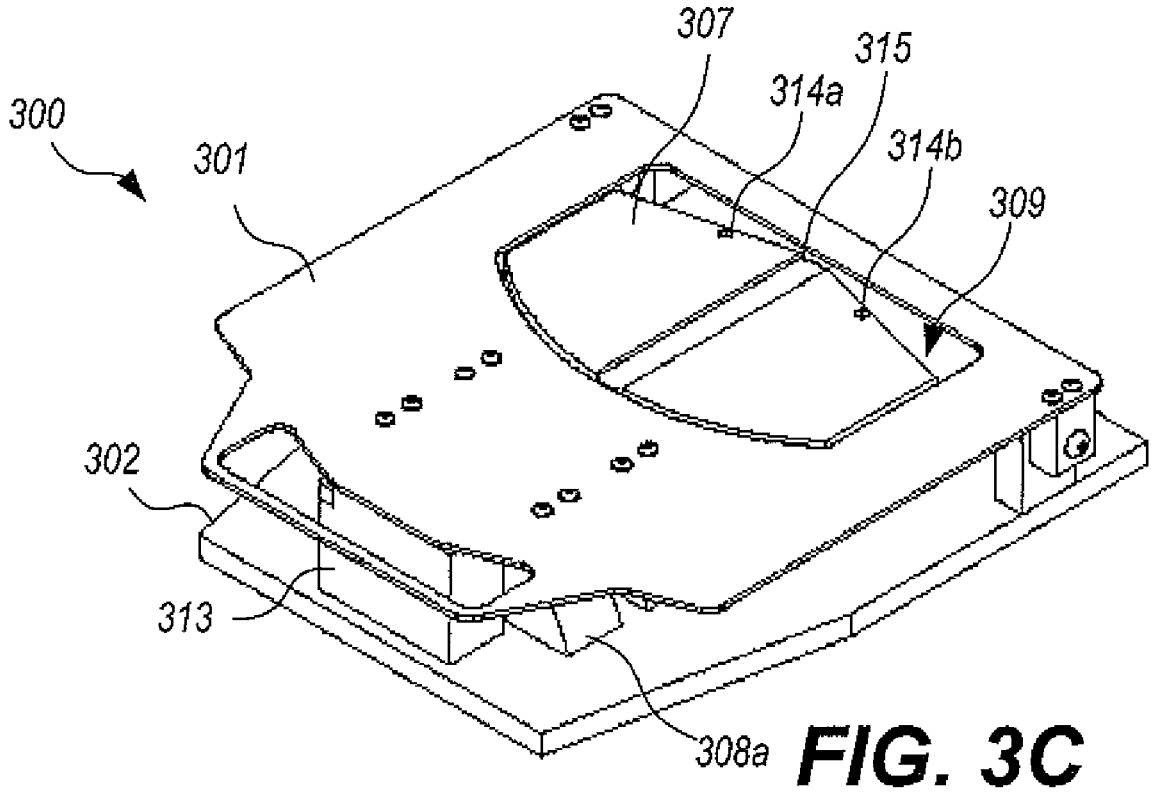
FIG. 3C is a perspective view of the hat pallet of FIG. 3A with the top plate closed.
Figure 3D:
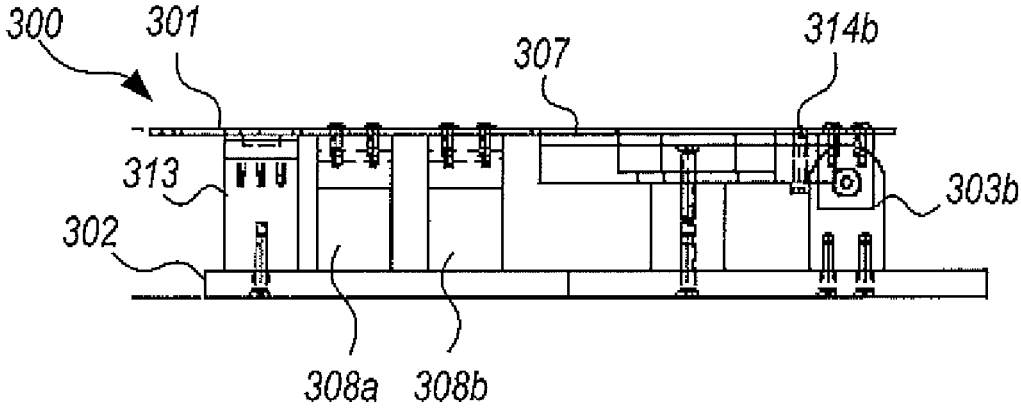
FIG. 3D is a side view of the hat pallet of FIGS. 3A-3C with the top plate closed.
Figure 4C:
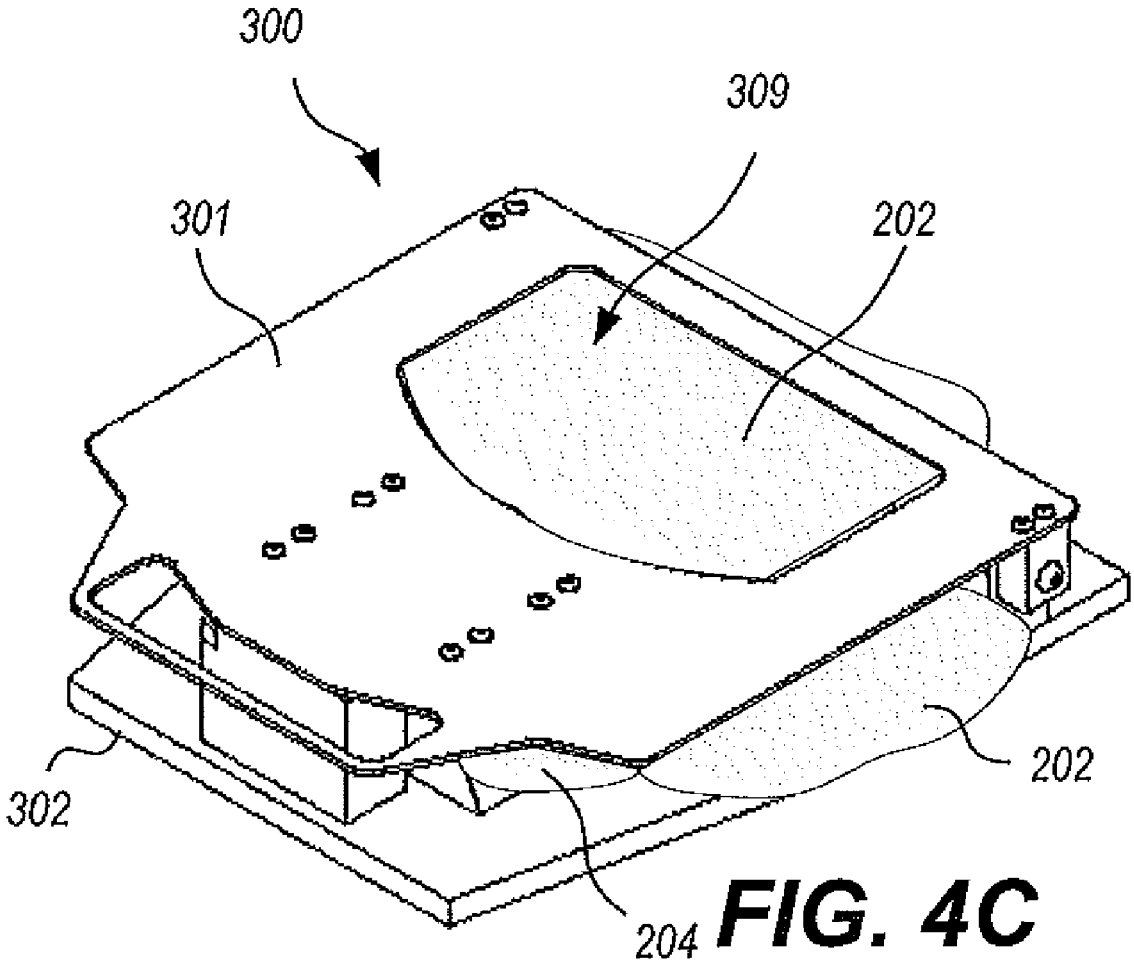
FIG. 4C is a perspective view of the hat pallet of FIGS. 3A-3D with a hat mounted in the pallet and the top plate in the closed position.
Figure 4D:
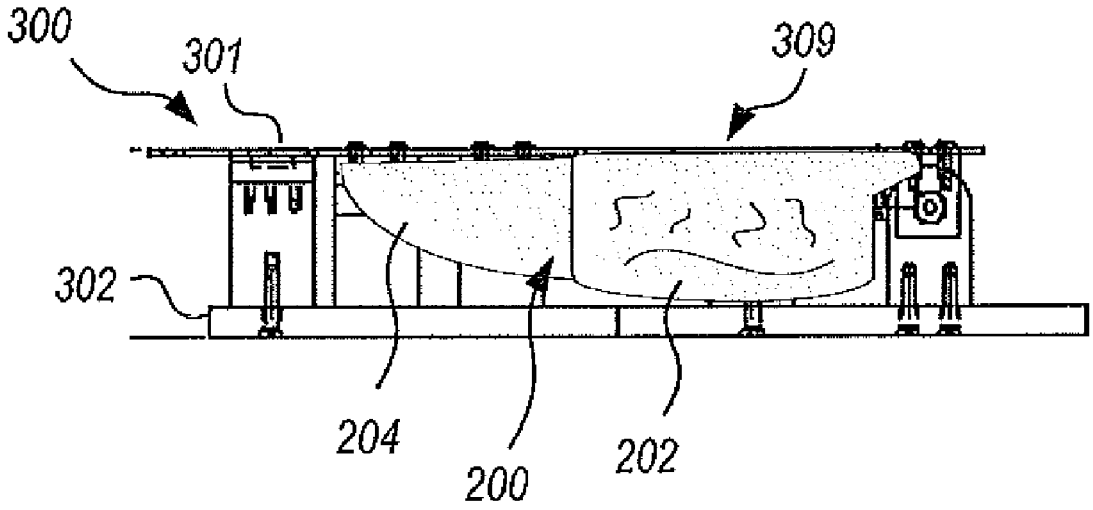
FIG. 4D is a side view of the hat pallet of FIGS. 3A-3D with the hat mounted in the pallet and the top plate in the closed position.

FIG. 2 depicts a standard baseball cap 200. As shown, the baseball cap 200 includes a soft cap 202, for example made of fabric, with a bill 204 in the form of a long, stiffened and curved peak. The cap 202 may be fitted. Alternatively, the back of the cap 202, not shown, may include an adjustor strap made from plastic, Velcro, or elastic, so that it can be quickly adjusted to fit the size of the head of the wearer. The cap 202 is generally hemispherically shaped wherein the 3-dimensional curves are achieved by sewing a plurality of sections 203 together. Since the bill 204 is traditionally worn over the eyes, the printed image 206 is typically printed on the cap 202 above the bill 204. While embodiments described herein show a hat pallet for printing above the bill, it is to be understood that the hat pallet may be modified to print the image on other areas of the cap while still securing the bill during printing.

FIGS. 3A-3F together illustrate an exemplary embodiment of a novel pallet 300 for a baseball cap. The pallet 300 may be mounted on the printing table 102 in a printer 100 such as that shown in FIGS. 1A and 1B and used to print an image on an area of the hat.

As illustrated in FIGS. 3A-3D, the pallet 300 includes a top plate 301 hingeably mounted by hinges 303*a*, 303*b* to a bottom plate 302. The top plate 301 may be moved between an open position, shown in FIGS. 3A and 3B, and a closed position, shown in FIGS. 3C and 3D. In an embodiment, the top plate 301 is hingeably mounted by hinges 303*a*, 303*b* to a bottom plate 302 and is in the closed position when the top plate 301 is rotated down over the bottom plate 302 such that the top plate 301 and bottom plate 302 form substantially parallel planes. The top plate 301 may be held securely over the bottom plate 302 by a locking or clamping mechanism 313 when the top plate 301 is in the closed position to provide compressive force on the hat (discussed hereinafter) when a hat is mounted in the pallet. In one embodiment, the locking mechanism 313 is a magnetic latch comprising a magnet mounted on the top side of the bottom plate 302 and a matching magnet mounted in corresponding position on the underside of the top plate 301 such that the magnets on the top and bottom plates attract and compress the plates together. Alternatively, the locking mechanism 313 may be implemented using any type of mechanical latch.

A printing plate 307 is fixedly mounted on the bottom plate 302, the top surface of which is to engage the underside of the area of the cap on which the image is to be printed. The printing plate 307 is preferably configured with a curved edge that follows the curve of the cap along the bill attachment. This allows printing closer to the bill of the hat.

A bill support 308, in one embodiment formed of a pair of semi-circular blocks 308*a*, 308*b*, is fixedly mounted on the bottom plate 302. The bill support 308 preferably substantially conforms to the shape and curve of the bill 204 of the baseball cap 200. The bill support 308 also is preferably shaped to allow the hat to sit on the pallet in a manner whereby the bill 204 and fabric of the cap 202 above the bill 204 lie along a substantially horizontal plane. The bill support 308 is positioned close enough to the bottom edge (where the bottom edge of the image will be printed) of the printing plate 307 so as to allow printing on the cap within a centimeter or less (or more, if desired) of the edge of the cap abutting the bill. In one embodiment, the bill support 308 is positioned such that, when a hat (e.g., baseball cap 200) is mounted in the pallet 300, the bill 204 of the baseball cap 200 is fully supported by the bill support 308 and an image is printed on the area of the cap 202 beginning just a centimeter above the bill 204.

The top plate 301 includes an opening 309 which, when the top plate 301 closes onto the bottom plate 302, exposes at least a portion of the printing plate 307. In one embodiment, the opening substantially conforms to the shape of the printing plate 307 such that all or nearly all of the printing plate 307 is exposed through the opening 309 when the top plate 301 is closed over the bottom plate 302.

The top plate 301 also includes a plurality of compression spacers 310*a*, 310*b*, 310*c*, 310*d* fixedly attached to the underside of the top plate 301 in a position such that, when the top plate 301 is closed onto the bottom plate 302, the compression spacers 310*a*, 310*b*, 310*c*, 310*d* compress onto the surface of the bill supports 308*a*, 308*b*. The compression spacers 310*a*, 310*b*, 310*c* 310*d* not only hold the bill 204 securely in place, but they also serve to help form the shape the bill during printing and prior to drying. Thus, when a hat is mounted therein, the hat bill 202 is held securely in place due to the compression between the bill supports 308*a*, 308*b* and compression spacers 310*a*, 310*b*, 310*c*, 310*d*, as illustrated in FIGS. 4A-4D. In one embodiment the compression spacers 310*a*, 310*b*, 310*c*, 310*d* comprise curved rubber blocks, the curves substantially complimenting the curves of respective areas of the bill support blocks 308*a*, 308*b* that they will be compressed against.

In an embodiment, the surface of the printing plate is non-tactile, such as an aluminum, steel, stainless steel, or other non-tactile surface. In an alternative embodiment, the surface of the printing plate 307 is tactile, such as a rubber or other such tactile surface.

At least one of the printing plate 307 and bottom plate 302 preferably includes at least one geometric feature, and the top plate 301 preferably includes at least one corresponding complimentary feature, such that when the top plate 301 is closed onto the bottom plate 302, the complimentary feature on the top plate 301 mates with its corresponding geometric feature. In one embodiment, the at least one geometric feature comprises a pair of steps 311*a*, 311*b*, built into the respective sides of the printing plate 307, and the corresponding complimentary features comprises a pair of mating blocks 312*a*, 312*b*. Preferably, to maximize the tautness of the portion of the hat to be printed, the blocks 312*a*, 312*b* have a rubber or other tactile surface. Referring to FIGS. 4A-4D, when a hat is mounted on the pallet 300, the blocks 312*a*, 312*b* on the top plate 301 begin to engage the fabric of the cap 202 as the top plate 301 is closed over the bottom plate 302. As the top plate 301 is further closed, the fabric is pulled by the blocks 312*a*, 312*b* so that when the top plate 301 is fully closed over the bottom plate 302, the fabric of the portion of the hat over the printing plate 307 is flat and taut. Such complementary geometric features serve to automatically flatten and pull taut the portion of the cap being printed on, thereby assisting in reducing the time it takes to mount a hat in the pallet.

The printing plate 307 preferably includes one or more anchor pins 314*a*, 314*b*, which protrude a small distance (a few or even less millimeters) above the surface of the printing plate 307. The anchor pins 314*a*, 314*b* may be strategically placed to serve not only to hold the cap in place during printing, but also as alignment guides that assist the printer operator in loading the cap onto the pallet 300. Furthermore, the anchor pins 314*a*, 314*b* facilitate the stretching of the cap fabric into a taut, or nearly taut, position during the initial loading of the cap 200 onto the pallet 300.

The printing plate 307 may further comprise one or more alignment indicators. For example, in one embodiment, the printing plate includes an inscribed line 315 or set of lines indicating where the center of the plate 307 is located. The line(s) 315 may, for example, align with the center seam of the front of the cap 202, and therefore may facilitate faster and more accurate loading of a hat in the pallet 300. Other lines or indicators may be implemented.

Preferably, the pallet 300 is manufactured to be as rust-proof as possible, as the printing, curing, and drying process can subject the pallet to moisture. For example, in an embodiment, the pallet is made completely of aluminum or other rust-free or low-rust material, and the hinges 303*a*, 303*b* may be fully enclosed. Furthermore, all mounting bolts may be made of stainless steel.

Variations of the illustrated hat pallet 300 may be implemented without departing from the scope of the claimed invention. For example, the hinges of the pallet 300 may alternatively be implemented on a different side of the pallet, and not just the back side as shown. The bill support 308 may be a single block or may be hollow or made of a stiff (e.g., steel) netting or other material.

Figure 1B:
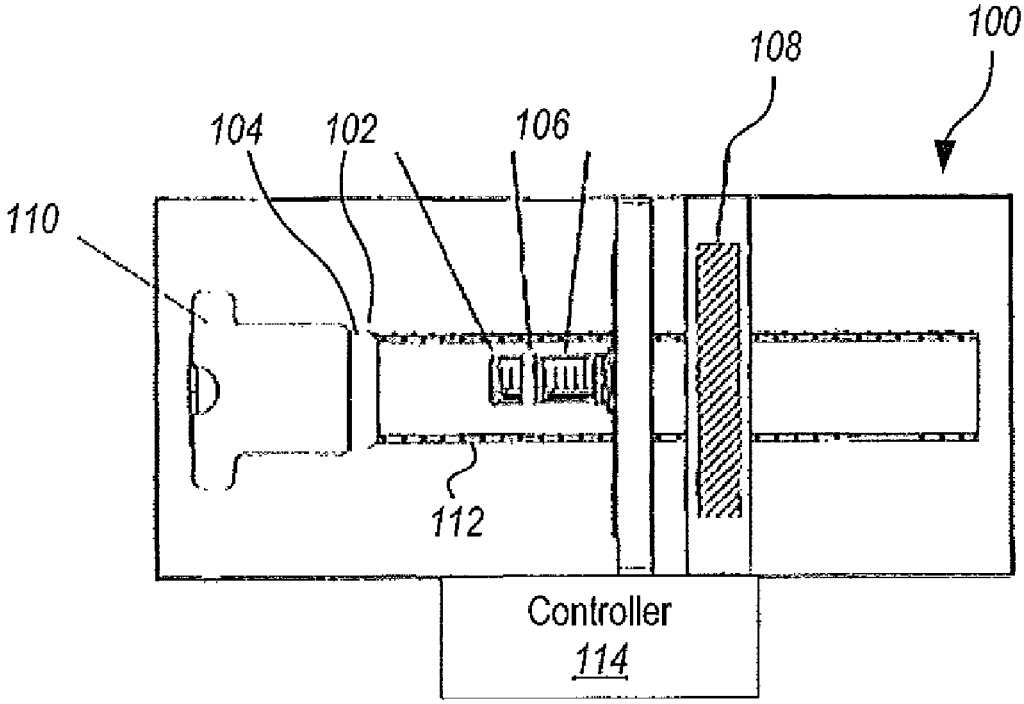
FIG. 1B is a top view of the digital image printer of FIG. 1A.
Figure 5:
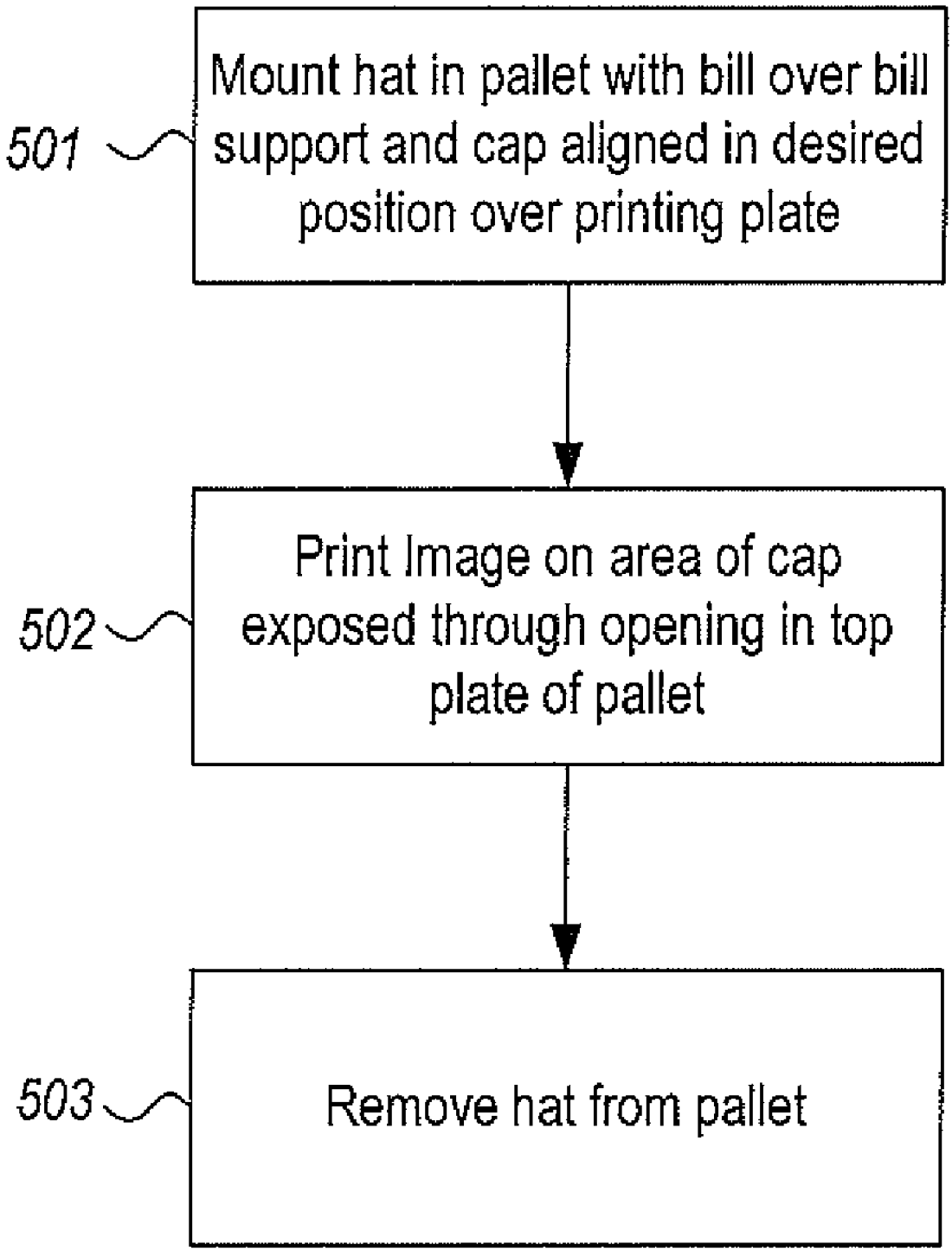
FIG. 5 is a flowchart illustrating a method of printing a digital image on the hat pallet.

FIG. 5 illustrates an exemplary method for directly printing an image on a hat, for example using the printer 100 of FIGS. 1A, 1B. In this method, a hat is mounted on a pallet implemented according to the principles of the invention, for example a pallet implemented as in FIGS. 3A-3D, and mounted as shown in FIGS. 4A-4D (step 501). Thus, the pallet preferably comprises a bottom plate 302, a printing plate 307 and a bill support 308 each fixedly mounted on the bottom plate 302, and a top plate 301 mountable over the bottom plate and having an opening 309 exposing at least a portion of the printing plate 307 when the top plate 301 is mounted over the bottom plate 302, wherein the bill support 308 is positioned relative to the printing plate 307 such that when the hat 200 is mounted on the pallet 300 and the top plate 301 is mounted on the bottom plate 302, a portion of the cap 202 is exposed through the opening of the top plate 301 and the underside of the bill 204 of the hat is supported by the bill support 308. The method continues with the printing of an image on the portion of the cap 202 exposed through the opening 309 of the top plate 301 of the pallet 300 (step 502), and the removing the hat 200 from the pallet 300 (step 503).

While an exemplary embodiment of the invention has been discussed, the described embodiment is to be considered as illustrative rather than restrictive. The scope of the invention is as indicated in the following claims and all equivalent methods and systems.

What is claimed is:

1. A pallet for holding a hat for printing, the hat comprising a cap and a bill attached to the cap, the pallet comprising:

a bottom plate;

a printing plate mounted on the bottom plate and having a top surface defining a plane;

a top plate movable between an open position and a closed position, the top plate comprising an opening; and a bill support mounted on the bottom plate and configured to support the bill along the plane of the printing plate;

wherein the bill support is positioned such that when the hat is mounted in the pallet with the top plate in the closed position, a portion of the cap on which the image is to be printed is supported on the printing plate and exposed through the opening of the top plate and the underside of the bill of the hat is supported by the bill support such that the bill and exposed portion of the cap lie along the same plane.

2. The pallet of claim 1, wherein the bill support comprises at least one semi-circular block.

3. The pallet of claim 1, wherein the bill support substantially conforms to a desired shape and curve of the bill of the hat.

4. The pallet of claim 1, wherein the bill of the hat comprises a curved peak and the bill support is configured to support a peak of the bill and the exposed portion of the cap above the bill along the same plane.

5. The pallet of claim 1, further comprising:

at least one compression spacer fixedly attached to the underside of the top plate in a position such that, when the top plate is in the closed position, the at least one compression spacer compresses the bill of the hat against the bill support.

6. The pallet of claim 5, wherein the surface of the at least one compression spacer comprises a tactile material.

7. The pallet of claim 5, wherein the at least one compression spacer comprises at least one curve which substantially compliments a corresponding curve of the bill support against which the bill of the hat will be compressed.

8. The pallet of claim 1, wherein a surface of the printing plate is tactile.

9. The pallet of claim 1, wherein a surface of the printing plate is non-tactile.

10. The pallet of claim 1, wherein:

at least one of the printing plate and bottom plate comprises at least one geometric feature; and the top plate comprises at least one corresponding complimentary feature, such that when the top plate is in the closed position, the at least one corresponding complimentary feature mates with its corresponding at least one geometric feature on the at least one of the printing plate and bottom plate.

11. The pallet of claim 10, wherein at least one of the at least one geometric feature and the at least one corresponding complimentary feature has a tactile surface.

12. The pallet of claim 11, wherein the at least one geometric feature comprises at least one step feature on a side of the printing plate, and the at least one corresponding complimentary feature comprises a block which engages the step feature when the top plate is in the closed position.

13. The pallet of claim 12, wherein at least one of the step feature and the block has a tactile surface.

14. The pallet of claim 1, wherein the printing plate comprises one or more anchor pins protruding from the top surface of the printing plate.

15. The pallet of claim 14, wherein the one or more anchor pins are positioned to serve as alignment guides.

16. The pallet of claim 1, wherein the printing plate comprises one or more alignment indicators for facilitating alignment of a hat on the pallet.

17. The pallet of claim 16, wherein at least one of the alignment indicators comprises at least one line indicating a center line of the printing plate.

18. The pallet of claim 1, wherein at least the bottom plate, the top plate, and the printing plate are made of a rust-proof material.

19. The pallet of claim 1, wherein the printing plate comprises a curved edge facing the bill support which follows the curve of the cap at a point of attachment to the bill.

20. A method for producing a hat having an image printed thereon, the hat comprising a cap with a bill attached thereto, the method comprising:

mounting a hat on a pallet, the pallet comprising a bottom plate, a printing plate and a bill support each mounted on the bottom plate and having respective top surfaces defining a plane, and a top plate movable between an open position and a closed position and having an opening, wherein the bill support is positioned such that when the hat is mounted on the pallet and the top plate is in the closed position, a portion of the cap is positioned on the printing plate and exposed through the opening of the top plate and the underside of the bill of the hat is supported by the bill support such that the bill and exposed portion of the cap lie along the plane defined by the top surfaces of the printing plate and bill support;

printing an image on the portion of the cap exposed through the opening of the top plate; and removing the hat from the pallet.

* * * * *